US010670367B1

(12) United States Patent
Boyer et al.

(10) Patent No.: US 10,670,367 B1
(45) Date of Patent: Jun. 2, 2020

(54) AMBIDEXTROUS SAFETY SELECTOR FOR RIFLE

(71) Applicants: Brent David Boyer, Fayetteville, AR (US); William Logan Garland, Westminster, CO (US); Aaron Neal Trout, Fayetteville, AR (US)

(72) Inventors: Brent David Boyer, Fayetteville, AR (US); William Logan Garland, Westminster, CO (US); Aaron Neal Trout, Fayetteville, AR (US)

( * ) Notice: Subject to any disclaimer, the term of this patent is extended or adjusted under 35 U.S.C. 154(b) by 0 days.

(21) Appl. No.: 16/381,543

(22) Filed: Apr. 11, 2019

(51) Int. Cl.
*F41A 17/46* (2006.01)
*F41A 35/06* (2006.01)

(52) U.S. Cl.
CPC ..... *F41A 35/06* (2013.01); *F41A 17/46* (2013.01)

(58) Field of Classification Search
CPC ..... F41A 17/46; F41A 35/06
USPC ..... 42/70.01, 70.06, 70.07
See application file for complete search history.

(56) References Cited

U.S. PATENT DOCUMENTS

| | | | | |
|---|---|---|---|---|
| 8,276,502 | B1 | 10/2012 | Wright | 89/138 |
| 8,756,847 | B2 | 6/2014 | Huther | 42/70.04 |
| 8,806,790 | B1 * | 8/2014 | Huang | F41A 17/74 42/70.08 |
| 9,557,128 | B2 | 1/2017 | Miller, III | 42/70.01 |
| 9,562,733 | B2 | 2/2017 | Huther | |
| 9,587,897 | B1 * | 3/2017 | Huang | F41A 17/56 |
| 10,126,081 | B1 * | 11/2018 | Geissele | F41A 17/46 |
| 10,466,001 | B1 * | 11/2019 | Huang | F41A 17/56 |
| 10,466,002 | B1 * | 11/2019 | Geissele | F41A 19/02 |
| 2017/0176122 | A1 * | 6/2017 | Underwood | F41A 19/46 |

OTHER PUBLICATIONS

"Semi-Auto Ambi Safety Selector"; https://www.knightarmco.com/12453/shop/rifle-partsaccessories/semi-auto-ambi-safety-selector (Year: 2014).*

"Talon Ambidextrous Safety Selector 2-Lever Kit—AR15"; https://radianweapons.com/talon-ambidextrous-safety-selector-2-lever-kit-ar15 (Year: 2014).*

* cited by examiner

*Primary Examiner* — Samir Abdosh
(74) *Attorney, Agent, or Firm* — Keisling & Pieper PLC; Trent C. Keisling

(57) ABSTRACT

An ambidextrous safety selector assembly for use with a rifle having a receiver with holes into which the assembly is inserted and that includes a main body with a user manipulated tab on the exterior of a rifle receiver and an elongated portion that extends into the receiver with a terminal channel defining three clocking faces and an intermediate hole that mate with protruding male faces with a terminal pin on a secondary body with a user manipulated tab on the exterior of a rifle receiver. The male faces of the secondary body are inserted and coupled into the terminal channel of the main body and clocked against the faces of the channel and the pin of the secondary body is inserted and coupled into the hole of the main body when the main body and secondary body are inserted into the receiver. The secondary body also has a foot protruding outwardly and extending into the receiver to retain the assembly in the receiver.

8 Claims, 9 Drawing Sheets

AMBIDEXTROUS SAFETY SELECTOR FOR RIFLE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates generally to firearms and, more particularly, to an improved ambidextrous safety selector on firearms such as rifles and the like. The invention is particularly well-suited for rifles commonly identified as M-16's and/or AR-15's. Known art can be found in U.S. Classes 1, subclass 1, and in other classes and subclasses.

2. Description of the Known Art

Those skilled in the art will appreciate that firearms, including long guns and pistols, have been used by military personnel in their duties and by sporting enthusiasts for both sporting and hunting endeavors for many years. Over the years, many sportsmen have used firearms similar to military firearms in these sporting (e.g. several different types of shooting competitions) and hunting events by literally thousands if not millions of persons every year. A particularly popular military firearm commonly known as the M-16 has been sold to the public commercially as the AR-15 for many years and has been widely adopted by sportsmen as well as the general public.

Most commercially produced AR-15's use a safety system that is well-suited for right handed users but that must be modified for left hand users. It is desirable to have an ambidextrous safety selector for this rifle that may be easily used by right or left handed users and especially without additional or extensive modifications to the firearm.

Known art which may be relevant to the present invention includes the following patents with their abstracts, the teachings of which are incorporated by reference.

U.S. Pat. No. 9,562,733 entitled Firearm fire control selector and issued on Feb. 7, 2017, to Huther is for a method of providing a semi-automatic rifle with a reversible safety selector is provided. The method including the steps of: removably and rotatably locating a reversible safety selector in a receiver having a first side and an opposite second side, the reversible safety selector having a selector member and a shaft extending therefrom, the shaft being rotationally received within the receiver and the shaft further comprising a first position selection feature proximate to the selector member and a second position selection feature distal to the selector member, wherein a camming surface is located between the first position selection feature and the second position selection feature, wherein the first position selection feature is configured to only engage a spring biased detent of the receiver when the reversible safety selector is rotated between a first position and a second position with respect to the receiver when the selector member is located on the first side of the receiver, wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver. This device only has a selector on one side of the rifle that must be moved to the other side of the rifle to accommodate off hand users.

U.S. Pat. No. 8,756,847 entitled Firearm fire control selector and issued on Jun. 24, 2014, to Huther, is for a firearm fire control selector for a semi-automatic M-4 type firearm is provided. The firearm comprises a receiver and a reversible safety selector. The receiver has a right side and a left side. The reversible safety selector is rotatably coupled to the receiver and comprises a shaft with a user selector member at one end. The user selector member is adapted to allow a user to move the reversible safety selector relative to the receiver. The reversible safety selector is adapted to be mounted to the receiver in a first position with the user selector member located on the right side of the receiver. The reversible safety selector may be mounted to the receiver in a second position different from the first position with the user selector member located on the left side of the receiver. This device only has a selector on one side of the rifle and must be moved to the other side to accommodate off hand users.

U.S. Pat. No. 9,557,128 entitled Reversible safety selector for AR15-type firearm and issued on Jan. 31, 2017, to Miller, III, is for a reversible safety selector switch for an AR15-type firearm including a control shaft and a control lever. The control shaft is pivotably mountable about an axis in a lower receiver and has a cam portion with first and second cam surfaces and a detent portion having a surface and first and second detent grooves with detent sockets at each end of each groove. The first detent groove extends circumferentially approximately 90 degrees along the surface and the second detent groove extending circumferentially less than 90 degrees along the surface. A control lever is connectable to an end of the control shaft and configured for manipulation outside the receiver by a user to axially rotate the control shaft. When the selector is installed in the receiver, a detent pin in the receiver engages one of the detent grooves and prevents axial rotation beyond a detent socket, the first cam surface and first detent groove are positioned to allow axial rotation of the shaft between "safe" and "fire" positions in approximately 90 degrees of rotation and the second detent groove being positioned to allow axial rotation of the shaft between "safe" and "fire" positions in less than 90 degrees of rotation when installed with the detent pin engaging the second detent groove. This device requires a threaded fastener on the exterior of the firearm to secure it for rotation.

U.S. Pat. No. 8,276,502 entitled Ambidextrous safety lever and issued on Oct. 2, 2012, to Wright, is for an ambidextrous or reversible safety mechanism for firearms. The safety mechanism can be utilized on specific rifles and shotguns, for example an AK47, SAIGA or similar firearms, as a retrofit to reposition the existing safety mechanism to a configuration similar to or nearly identical to an AR15, M16 or similar firearms. In this way, personnel familiar with the safety operation of the AR15 or M16 will be able to operate the retrofit firearm without learning the operation of a new mechanism. Once retrofitted, the firearm safety mechanism will have the same visual appearance, action, and "feel" as the firearm with which they are familiar. The distance from the grip (trigger) to the engagement portion of the safety mechanism of the retrofit firearm will be very similar to that of the familiar firearm. This device requires a threaded fastener on the exterior of the firearm to secure it for rotation.

All of these references seek, to a greater or lesser extent, to provide an ambidextrous safety selector but are unsuited for one or more of the reasons discussed above.

Also, commercially available equipment and components may be relevant, including firearm trigger assemblies, conventional trigger safeties, and the like. Such equipment may be used in implementing exemplary embodiments in accordance with the present invention.

None of these references, either singly or in combination, disclose or suggest the present invention. It is desirable to have an improved ambidextrous safety selector for rifle to address the perceived shortcomings of the known art.

The purpose of the tool-less ambidextrous safety selector is to achieve all the functionality of a standard ambidextrous safety selector for an AR-15 rifle, with as few parts as mechanically possible. All known ambidextrous safety selectors use at least one additional locking component besides the safety selector detent. By using mating faces and a retaining boss, the ambidextrous safety system of the present invention can achieve complete functionality and reliability with only one more piece than a conventional safety selector for an AR-15 rifle. Along with the benefit of fewer parts, this assembly has the added advantage of being geometrically impossible to disassemble without intentional action from the user.

While it is evident from past attempts that safety selectors for guns are desirable, the known art is limited in its teaching and utilization, and an improved system is needed to overcome these limitations. An improved ambidextrous safety selector should provide a simple and efficient system for meeting the various needs of the users and the like.

SUMMARY OF THE INVENTION

The present invention addresses the perceived needs in the known art discussed above. In this regard, the present invention substantially fulfills this need. The ambidextrous safety selector for rifle may be advantageously used with long guns such as rifles or carbines or others using an elongated barrel and the like and it is particularly well-suited for use with an AR-15 type rifle.

In one exemplary embodiment in accordance with the present invention, an improved ambidextrous safety selector for firearm may be attached to the firearm without tools. The invention uses mating faces and a retaining boss coupled internally to achieve complete functionality and reliability with only one more piece than a conventional safety selector for an AR-15 type rifle The apparatus of the invention is capable of receiving additional, optional features which are not a part of the present invention. Other optional features, some of which may be illustrated herein, may or may not be included with apparatus incorporating the basic aspects of present invention.

In addition to providing the features and advantages referred to above, it is an object of the present invention to provide an improved ambidextrous safety selector for a firearm.

Another object of the present invention is to provide a safer firearm when shooting.

A basic object of the present invention is to provide a more pleasant shooting experience.

Another object of the present invention is to provide an ambidextrous safety selector that, after assembly inside the firearm, is geometrically impossible to disassemble without intentional action from the user.

A related object of the present invention is to provide an ambidextrous safety selector that enables user safety manipulation on both left and right sides of the firearm simultaneously.

Yet another object of the present invention is to enhance user comfort and to reduce the potential for unsafe handling of the firearm.

A related object of the present invention is to provide a more usable firearm for persons of left or right handed orientation.

These and other objects and advantages of the present invention, along with features of novelty appurtenant thereto, will appear or become apparent by reviewing the following detailed description of the invention in conjunction with the appended drawings.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
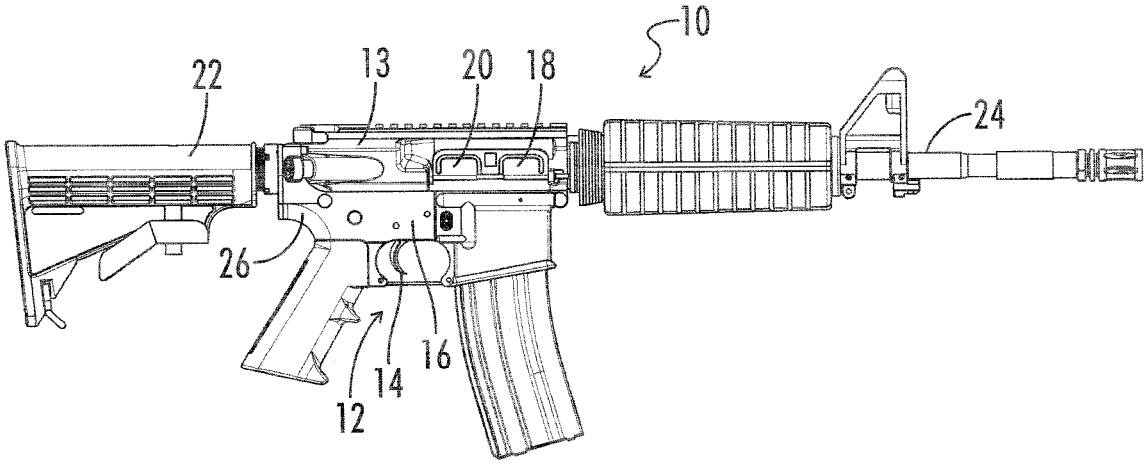
FIG. 1 is a side elevation view of a firearm taken generally from the right side thereof and incorporating features in accordance with an embodiment of the present invention.
Figure 2:
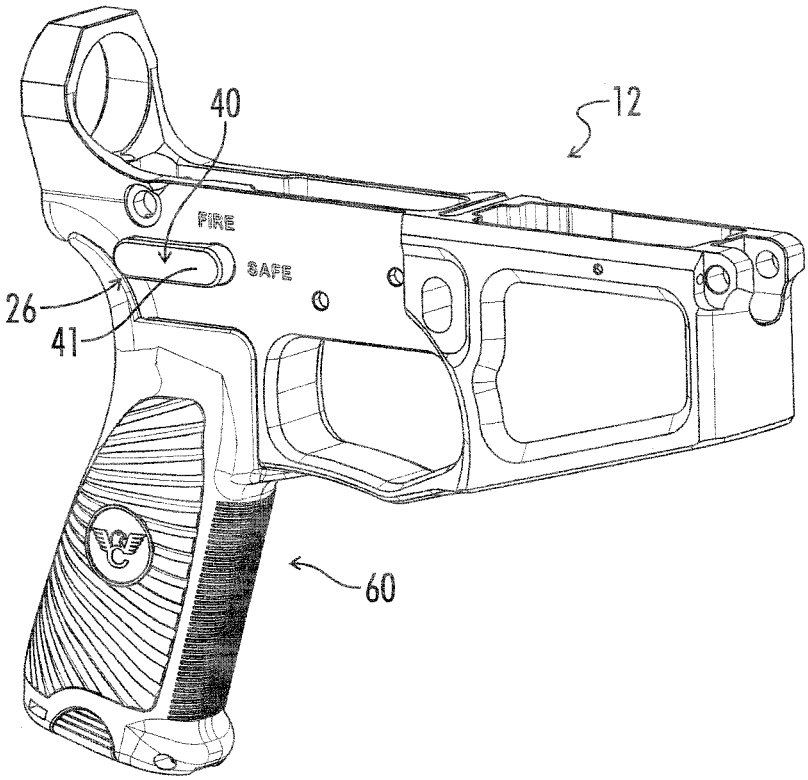
FIG. 2 is a perspective view taken generally from the front and right side of a firearm lower assembly with the ambidextrous safety selector for firearm in the safe position in accordance with an embodiment of the present invention and with portions of the firearm omitted for clarity.
Figure 3:
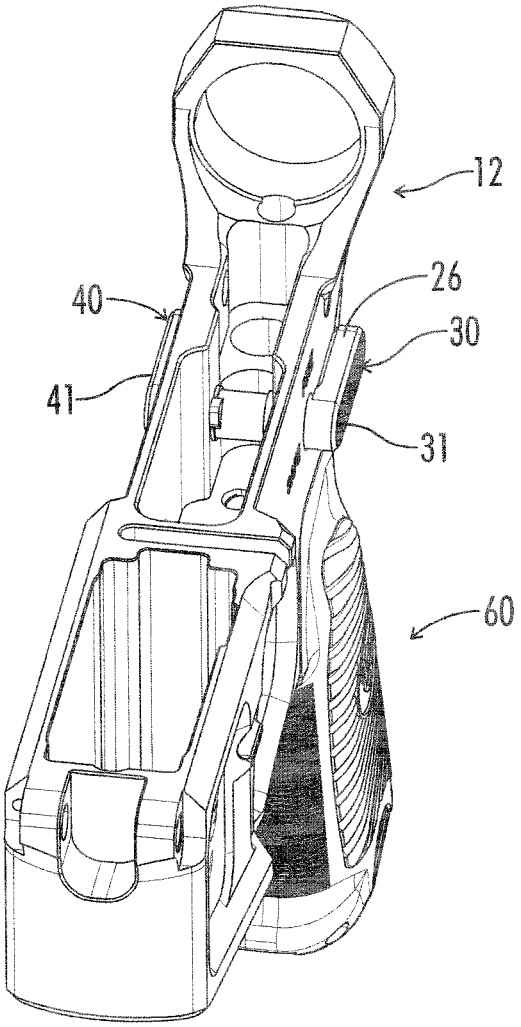
FIG. 3 is a perspective view taken generally from the top and left side thereof.
Figure 4:
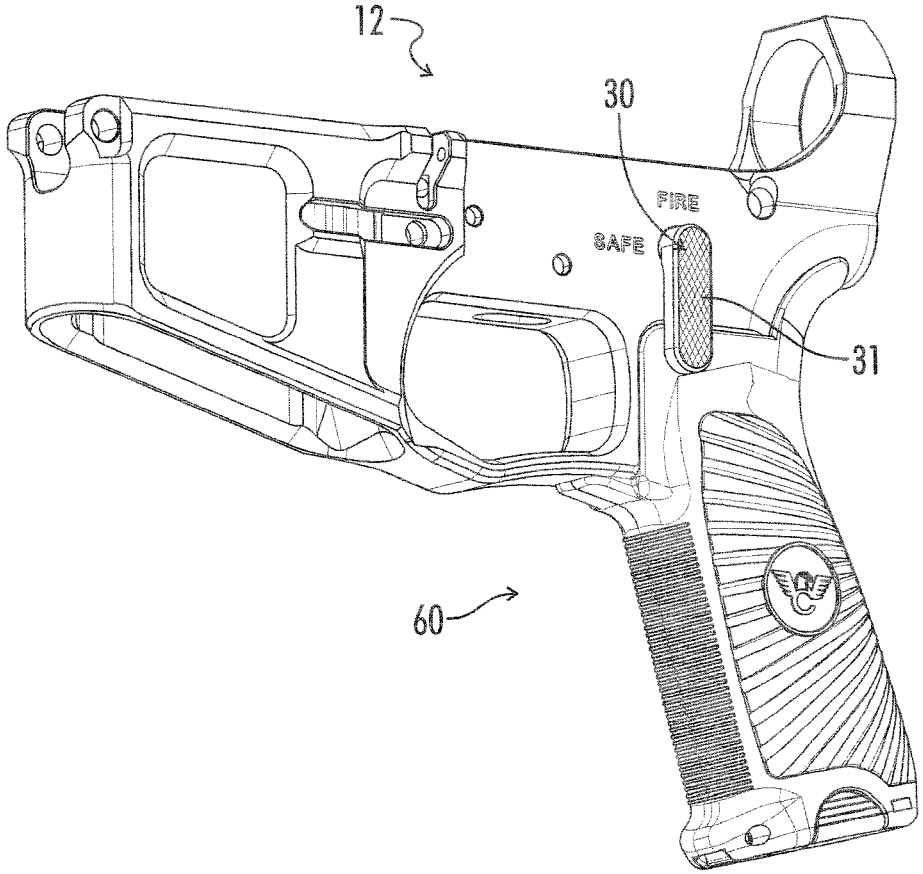
FIG. 4 is a perspective view taken generally from the front and right side of a firearm lower assembly similar to FIG. 2 but with the ambidextrous safety selector for firearm in the fire position.
Figure 5:
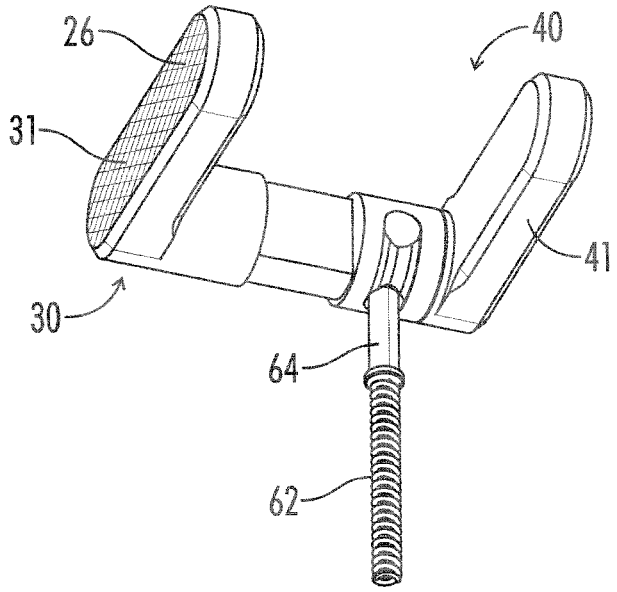
FIG. 5 is a perspective view of the ambidextrous safety selector with the retaining detent and spring in the safe position.
Figure 6:
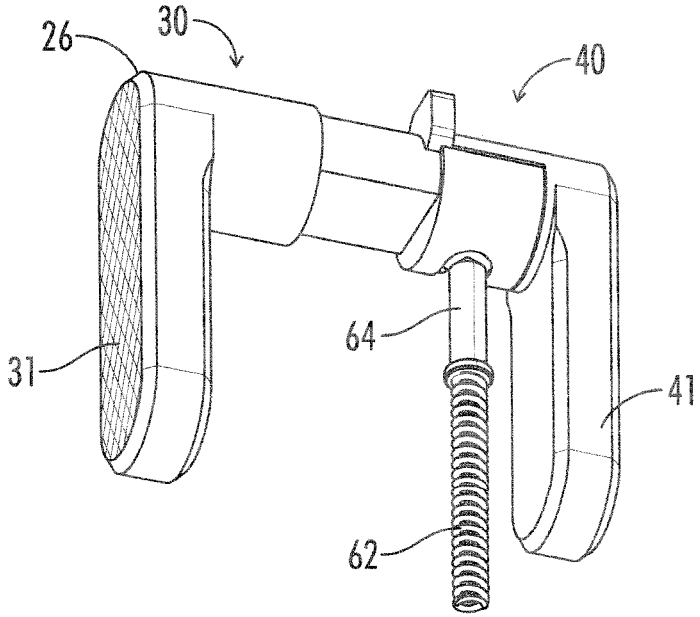
FIG. 6 is a perspective view of the ambidextrous safety selector with the retaining detent and spring similar to FIG. 5 but in the fire position.
Figure 7:
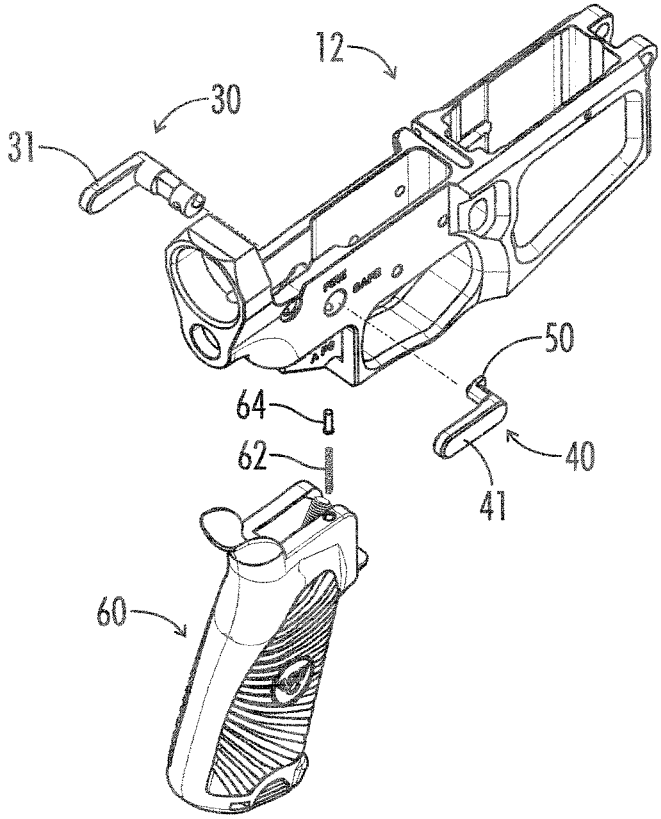
FIG. 7 is an exploded view of the lower assembly taken generally from the top and rear and with the ambidextrous safety selector and retaining detent and spring and pistol grip exploded from the lower assembly.
Figure 8:
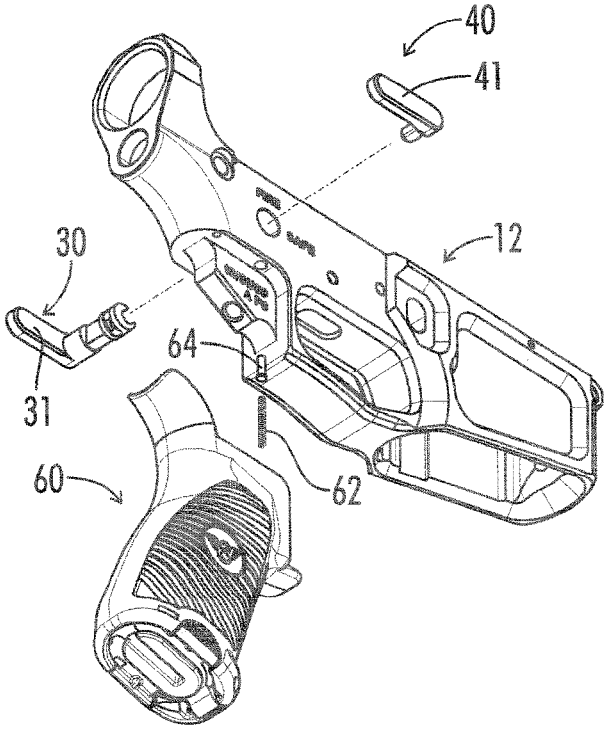
FIG. 8 is an exploded view of the lower assembly taken generally from the bottom and rear and with the ambidextrous safety selector and retaining detent and spring and pistol grip exploded from the lower assembly.
Figure 9:
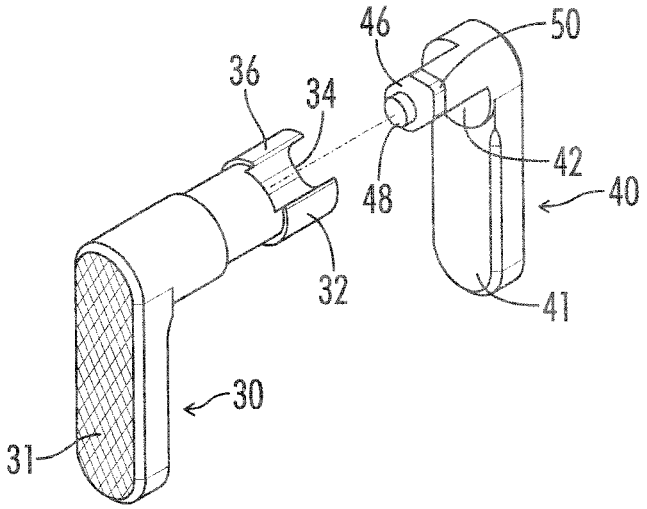
FIG. 9 is a perspective view taken generally from above and showing the main body and secondary body of the safety selector.
Figure 10:
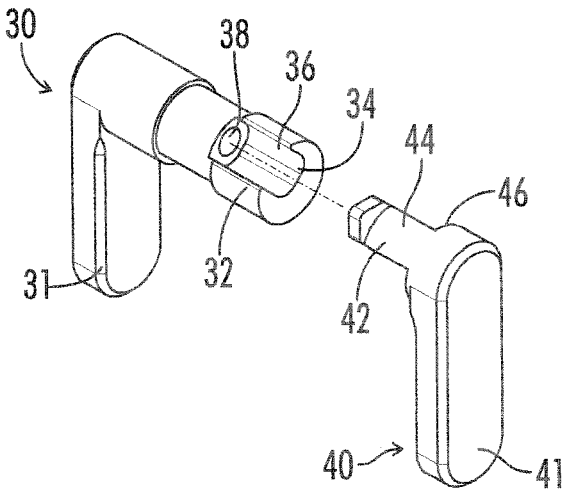
FIG. 10 is a perspective view similar to FIG. 9 but with the bodies rotated 90 degrees clockwise.
Figure 11:
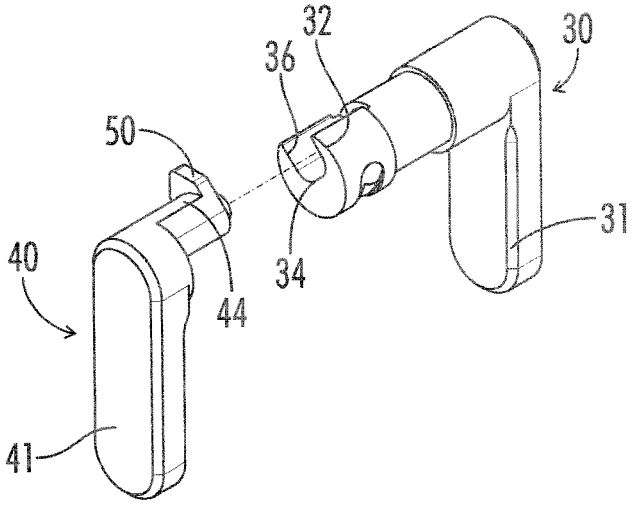
FIG. 11 is a perspective view similar to FIG. 9 but with the bodies rotated 180 degrees clockwise.
Figure 12:
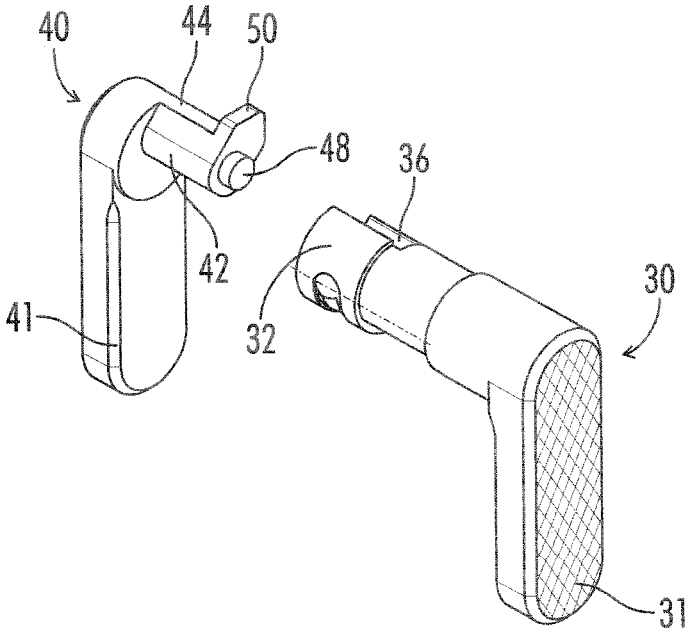
FIG. 12 is a perspective view similar to FIG. 9 but with the bodies rotated 270 degrees clockwise.
Figure 13:
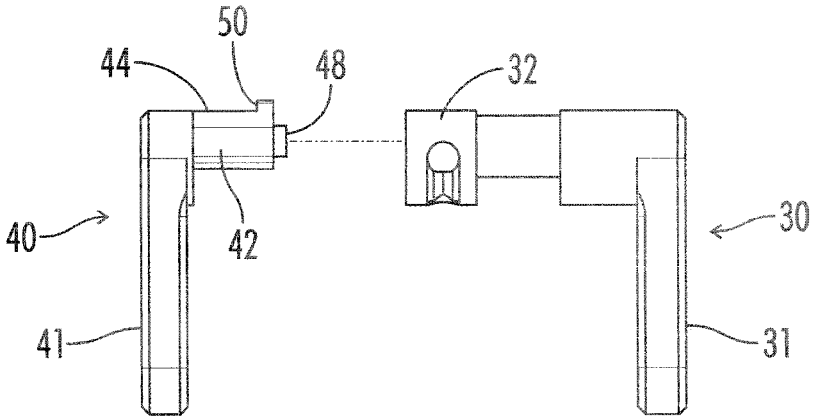
FIG. 13 is an elevational view showing the main body and secondary body of the safety selector.
Figure 14:
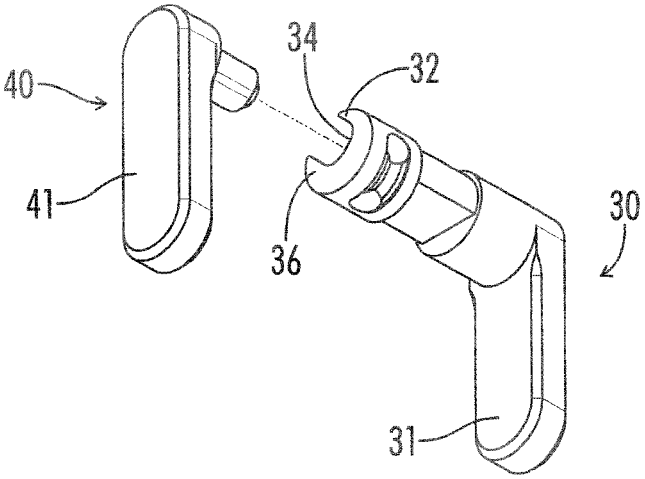
FIG. 14 is a perspective view taken generally from below and showing the main body and secondary body of the safety selector; and, FIG. 15 is a perspective view similar to FIG. 14 but with the bodies rotated 90 degrees clockwise.
Figure 15:
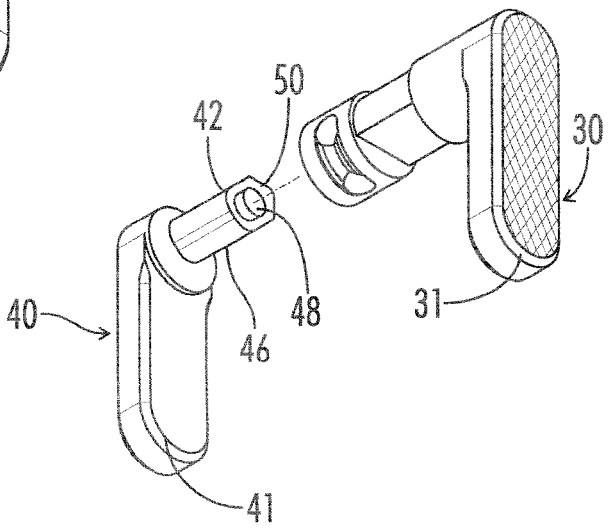

The present invention addresses the perceived needs in the known art discussed above. In this regard, the present invention substantially fulfills this need. In one exemplary embodiment in accordance with the present invention and shown in FIGS. 1-15, the ambidextrous safety selector for firearm is indicated by reference numeral 26. The selector 26 may be employed with conventional firearms such as the AR-15 and the like.

In the exemplary embodiment shown in FIG. 1 firearm 10 is depicted as a rifle type configuration. The rifle type configuration shown being known as the family of rifles originally developed for the U.S. Army and commonly known as an M-4, M-16 or AR15 type firearms for example purposes. In alternate embodiments the firearm may be of any other suitable type. Firearm 10 incorporates a firing mechanism capable of operation at least in a semi-automatic mode (i.e. the "FIRE" mode). The firing mechanism may also be placed in a "SAFE" mode. The firearm 10 has a mode or fire control selector assembly 26 allowing a user to select the mode of operation of the firing mechanism, and the firearm selector assembly 26 is ambidextrous as will be described in greater detail below. The firearm 10 and its sections is merely exemplary, and in alternate embodiments the firearm 10 may have other sections, portions or systems. The firearm generally has a receiver 12, which includes an upper receiver section 13 and a lower receiver section 16 with a pistol grip 60 with an inner selector retaining spring 62 and detent 64. Firearm 10 also has a trigger 14, and a fire control selector 26. The receiver 12 has a chamber 18 for receiving a bolt assembly 20. The rear portion of the chamber 18 may be defined by a receiver extension located in the stock 22 for receiving a buffer and operating spring. Connected to the forward portion of the chamber 18 is a barrel 24 having a cartridge chamber in which a cartridge may be positioned.

The selector assembly 26 includes a main body 30 and a secondary body 40 that are coupled within the receiver 12 to provide ambidextrous use of the firearm safety selector.

The main body 30 of the selector assembly 26 is similar to a conventional AR-15 safety selector in that it permits or interrupts trigger movement depending upon the setting of the selector assembly 26 (i.e., whether in the "FIRE" or "SAFE" mode). The main body 30 has a user manipulated tab 31 that mounts on the exterior of the receiver 12 and an inner portion that extends into the receiver 12. The body portion that is housed in the receiver during use has an elongated section with an internal safety cam and a terminal channel defining three flat clocking faces 32, 34 and 36. The clocking faces 32, 34, and 36 bound the channel and extend from the body terminal end toward the intermediate safety cam and an anti-tilt spot hole 38 that extends slightly (approximately 10 mm) into the cam. The clocking faces 32, 34, 36 ensure the assembly 26 stays in the same orientation throughout the entire operation. The anti-tilt spot hole 38 serves the purpose of preventing the assembly 26 from torqueing about its center of rotation.

The secondary body 40 of this assembly 26 is what provides the ambidextrous functionality. The secondary body 40 includes all of the male mating geometry for the previously mentioned clocking faces and anti-tilt spot hole. The secondary body 40 has a user manipulated tab 41 that mounts on the exterior of the receiver 12 and an inner portion that extends into the receiver 12. Secondary body 40 includes male clocking faces 42, 44, and 46 protruding outwardly from its base and culminating with and an anti-tilt pin 48 that is inserted into the spot hole 38. Additionally, a foot 50 protrudes outwardly from the mating face 44 to retain the body 40 from disassembling by locking it within the trigger pocket of the receiver 12.

The first step in assembling the selector assembly 26 is to insert the secondary body into the receiver 12. Since the retaining foot 50 of the secondary body 40 makes it impossible to insert the body 40 into the receiver 12 while in its functional position, the body 40 must first be inserted in such a way to clear the retaining foot 50 through the safety selector hole in the receiver 12. After the retaining foot 50 is inside of the receiver 12, locate the body 40 so the exterior diameter is concentric with the safety selector hole.

Next, the primary body 30 is inserted into the shooter left side of the receiver 12. At this point all mating faces/geometry must be properly aligned to locate the assembly 26 in its final functional format.

At this point the assembly 26 is clocked to itself and is resistant to torqueing about its axis of rotation. The final assembly step is inserting the selector detent 64 and spring 62 and seating the pistol grip 60 to secure the detent 64 and spring 62 inside the receiver 12. Once the detent 64 and detent spring 64 is inserted and securely seated by the pistol grip 60, the main body of assembly 26 is constrained from sliding out of the shooter left side of the receiver 12. This is the final step that completely restrains the assembly from disassembling in any direction.

The present invention is an improvement over the known art for at least two reasons. The first is that if a mechanism can be made to function similarly or better with fewer parts, then it is an improvement to use fewer parts. The second is that if a change to an assembly can be made that will decrease its odds of failure, then it is an improvement to the assembly.

Elaborating on the first point, the assembly discussed uses fewer parts than any other known art. Because the selector hole in the lower receiver of an AR-15 type rifle platform is a circular hole, and the safety selector interaction geometry must extend well beyond the bounds of the hole to be functional, it is understandable that the selector can only be inserted from one side of the receiver. When wanting to achieve ambidextrous functionality with the selector, the shooter right interaction geometry requires that the assembly have more than one piece. With more than piece present, it is necessary to mechanically constrain the parts together so that the assembly is clocked to itself, cannot vertically or horizontally disassemble, and remain functional for its original intended purpose. This set of requirements is satisfied by all known art with the use of some combination of the following: clocking faces, mated dovetail cuts, locating screw, spring loaded detent.

By using the retaining foot 50 of the secondary body 40, and the already present horizontal motion restriction of the selector detent 64, the assembly 26 achieves identical functionality with at least one fewer part than those of the known art.

The present invention also decreases the probability of failure in relation to the known art. All known art require a final assembly step be performed from the outside of the firearm 10. If the final step in assembly is performed from the outside of the firearm 10, then the first step of disassembly has a greater of chance of being actuated accidentally. Assemblies that rely on locating screws pose the risk of the screw starting to unthread under regular operation. Assemblies that rely on external detents have the risk of the detent being depressed during regular operation. Since the only way to assemble the present invention is by inserting the selector detent 64, the only way to disassemble the system is by removing the selector detent 64. The only way for the assembly 26 to fail is if the selector detent 64 fails first. It is believed that any safety assembly designed to achieve ambidexterity would fail under these circumstances. Therefore, the present invention has one less route to failure than any other known art.

Also, the present invention may be advantageously manufactured using convention techniques (i.e. cast, pressed, cut or the like) or even 3D printed or other additive manufacturing techniques.

In describing a preferred embodiment of the invention illustrated in the drawings, specific terminology has been used for the sake of clarity. However, the invention is not intended to be limited to the specific terms selected, and it is to be understood that each specific term includes all technical equivalents which operate in a similar manner to accomplish a similar purpose.

What is claimed is:

1. An ambidextrous safety selector assembly comprising:

a main body with a user manipulated tab on the one side of the exterior of a rifle receiver and having an elongated portion extending into the receiver with a terminal channel defining three clocking faces and with an intermediate hole; and, a secondary body with a user manipulated tab on the other side of the exterior of the rifle receiver and having an elongated portion extending into the receiver with protruding male clocking faces with a terminal pin and adapted to selectively couple to the main body.

2. The assembly as defined in claim 1 wherein the male faces of the secondary body are inserted and coupled into the terminal channel of the main body and clocked against the faces of the channel and the pin of the secondary body is inserted and coupled into the hole of the main body.

3. The assembly as defined in claim 1 wherein the secondary body further comprises a foot protruding outwardly and extending into the receiver to retain the assembly in the receiver.

4. An ambidextrous safety selector assembly for use with a rifle having a receiver with holes into which the assembly is inserted, the assembly comprising:

a main body with a user manipulated tab on the exterior of a rifle receiver and having an elongated portion adapted to extend into the receiver with a terminal channel defining three clocking faces and with an intermediate hole; and, a secondary body with a user manipulated tab on the exterior of a rifle receiver and having an elongated portion adapted to extend into the receiver with protruding male faces with a terminal pin and adapted to selectively couple to the main body.

5. The assembly as defined in claim 4 wherein the male faces of the secondary body are inserted and coupled into the terminal channel of the main body and clocked against the faces of the channel and the pin of the secondary body is inserted and coupled into the hole of the main body when the main body and secondary body are inserted into the receiver.

6. The assembly as defined in claim 5 wherein the secondary body further comprises a foot protruding outwardly and extending into the receiver to retain the assembly in the receiver.

7. An ambidextrous safety selector assembly for use with a rifle having a receiver with holes into which the assembly is inserted, the assembly comprising:

a main body with a user manipulated tab on the exterior of a rifle receiver and having an elongated portion and adapted to extend into the receiver with a terminal channel defining three clocking faces and with an intermediate hole; and, a secondary body with a user manipulated tab on the exterior of a rifle receiver and having an elongated portion and adapted to extend into the receiver with protruding male faces with a terminal pin and adapted to selectively couple to the main body and wherein the male faces of the secondary body are inserted and coupled into the terminal channel of the main body and clocked against the faces of the channel and the pin of the secondary body is inserted and coupled into the hole of the main body when the main body and secondary body are inserted into the receiver.

8. The assembly as defined in claim 7 wherein the secondary body further comprises a foot protruding outwardly and extending into the receiver to retain the assembly in the receiver.

* * * * *